United States Patent [19]

Egami

[11] 4,337,933

[45] Jul. 6, 1982

[54] JIG FOR MOUNTING A FRONT DERAILLEUR IN A BICYCLE

[75] Inventor: Tetsufumi Egami, Sakai, Japan

[73] Assignee: Shimano Industrial Company Limited, Osaka, Japan

[21] Appl. No.: 138,670

[22] Filed: Apr. 9, 1980

[30] Foreign Application Priority Data

Apr. 25, 2979 [JP] Japan ..... 54-56351[U]

[51] Int. Cl.[3] ..... B25B 1/20

[52] U.S. Cl. ..... 269/40; 269/43; 269/268; 269/909

[58] Field of Search ..... 269/37, 40, 43, 268, 269/904, 909; 33/174R, 174 G, 177; 405/288; 52/86, 729; 254/94

[56] References Cited

U.S. PATENT DOCUMENTS

| | | | |
|---|---|---|---|
| 395,875 | 1/1889 | Butler | 33/177 |
| 950,285 | 2/1910 | Harper | 33/177 |
| 1,961,659 | 6/1934 | Castaneda | 254/94 |

FOREIGN PATENT DOCUMENTS

| | | | |
|---|---|---|---|
| 388308 | 2/1933 | United Kingdom | 254/94 |

*Primary Examiner*—Robert C. Watson

*Attorney, Agent, or Firm*—Stevens, Davis, Miller & Mosher

[57] ABSTRACT

A jig for mounting a front derailleur on a frame at a bicycle. The jig has a main body opposite to the lateral side of one of a pair of guide plates and having a length along the lateral side of the guide plate. The main body has a receiving plate having a receiving face of a circular arc fit to the lower end face of the guide plate, and has an engaging portion engageable with the outer peripheral portion of the front chain gear. The receiving face, when the engaging portion engages with the outer peripheral portion of the chain gear, is adapted to be put in a proper position with respect to the chain gear, so that the guide plate is positioned along the receiving face to set the front derailleur in its mounting position onto the frame.

2 Claims, 5 Drawing Figures

JIG FOR MOUNTING A FRONT DERAILLEUR IN A BICYCLE

BACKGROUND AND SUMMARY OF THE INVENTION

This invention relates to a jig for mounting a front derailleur having a pair of guiding plates, on a frame of a bicycle in a proper position to correspond with the front chain gears.

The front derailleur should be mounted on the bicycle frame by keeping its guide plates in a position corresponding with the front chain gear.

For this purpose, a tightening band, which fixes the front derailleur to the bicycle frame, is adjusted in position by being moved vertical to or rotated around the frame. The adjustment is carried out visually with difficulty and considerable time and at present depends on only the sight of a worker. Hence, the front derailleur is often inaccurately set which results in a lowering of speed-change efficiency or the production of noise. Furthermore, a drive chain can escape from the front chain gear when changing the bicycle speed.

In the light of the aforesaid problem, this invention has been designed. An object of the invention is to provide a jig through which the front derailleur is readily mountable on the bicycle frame so as to be properly positioned with respect to the front chain gear.

The jig of the invention comprises a main body disposed opposite to a lateral side of one guide plate at the front derailleur and having a length extending along the lateral side. The main body has a receiving plate having a receiving face of circular arc to be fit to the lower end face of the guide plate and an engaging portion positioned at the lower portion of the receiving plate and engageable with the outer peripheral portion of the front chain gear. The receiving face, when the engaging portion engages with the outer peripheral portion of the front chain gear, is adapted to be set in the proper position with respect to the chain gear, so that the guide plate is located along the receiving face to set the front derailleur in its proper position.

Accordingly, the front derailleur is mountable readily on the bicycle frame in a simple operation using the jig of the invention so that the guide plate of the derailleur may be set in the proper position with respect to the front chain gear.

These and other objects and novel features of the invention will be apparent from the following description of an embodiment of the invention in accordance with the accompanying drawings.

BRIEF DESCRIPTION OF THE DRAWINGS

FIGS. 3 through 5 represent a front derailleur mounted on the bicycle frame by use of the jig, in which FIG. 3 is a front view of the front derailleur looking from the rear of the bicycle, FIG. 4 is a plan view of the front derailleur, and FIG. 5 is a sectional view taken on the line V—V in FIG. 4.

DETAILED DESCRIPTION OF THE INVENTION

Figure 1:
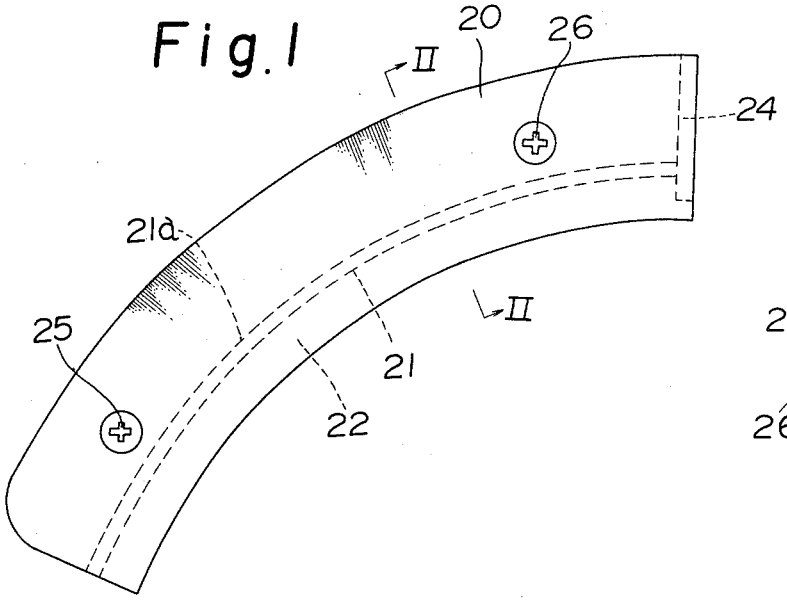
FIG. 1 is front view of a jig of the invention.

Prior to the description of a jig according to the invention, a front derailleur 3 to be mounted on a frame F of a bicycle by use of the jig, will be described according to FIGS. 3 through 5.

The frame F is a seat tube fixed to a bottom bracket (not shown) of the bicycle. The bottom bracket rotatably supports a crank means having two or more (usually two) front chain gears 1 and 2 of different diameters, the chain gears being so disposed that the larger diameter high speed gear 2 is positioned at the outside with respect to the frame F and a smaller diameter low speed gear 1. The front derailleur 3 is mounted on the frame F radially upwardly of the chain gears 1 and 2.

The front derailleur 3 is so constructed that a semicircular fixing member 4 carries a semicircular arm 5 pivoted thereto, the fixing member 4 and arm 5 abut at free ends thereof, and a bolt 6 is inserted through the free ends and screwably tightened with a nut 7, thereby fixing the fixing member 4 to the frame F. Two link members 8 and 9 are disposed in parallel to each other and pivoted to the fixing member 4, and a chain guide 10 is mounted on the foremost ends of link members 8 and 9 movable in parallel with respect to the fixing member 4.

The chain guide 10 comprises a pair of first and second guide plates 11 and 12. The guide plates 11 and 12 are arranged in parallel, and connected at a longitudinally intermediate portion, and also connected at the rear portion with a tubular connector 13, the first guide plate 11 being positioned inwardly with respect to the frame F and the second guide plate 12 being positioned outwardly of the frame F. A driving chain is interposed between the guide plates 11 and 12 and the chain guide 10 moves laterally to allow the guide plates 11 and 12 to push the chain, thereby switching the chain to one selected chain gear 1 or 2 for changing speed.

The jig according to the invention is used for mounting the aforesaid front derailleur accurately on the bicycle frame F in the proper position corresponding to the respective chain gears 1 and 2. Next, the jig will be detailed.

Figure 2:
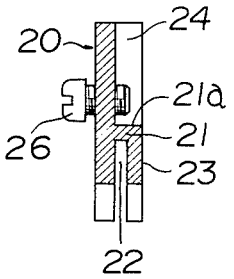
FIG. 2 is a sectional view taken on the line II—II in FIG. 1.

The jig according to the invention, as shown in FIGS. 1 and 2, comprises a main body 20 formed of a plate of circular arc, a receiving plate 21 projecting substantially perpendicularly from the lower portion of the body 20 and having a receiving face 21*a* of circular arc, and an engaging portion 22 engageable with the outer peripheral portion of one chain gear 1 or 2. When the engaging portion 22 engages with the chain gear 2 as shown in FIG. 3, the receiving face 21*a* is adapted to be set in a proper position with respect to teeth 2*a* of chain gear 2.

Figure 3:
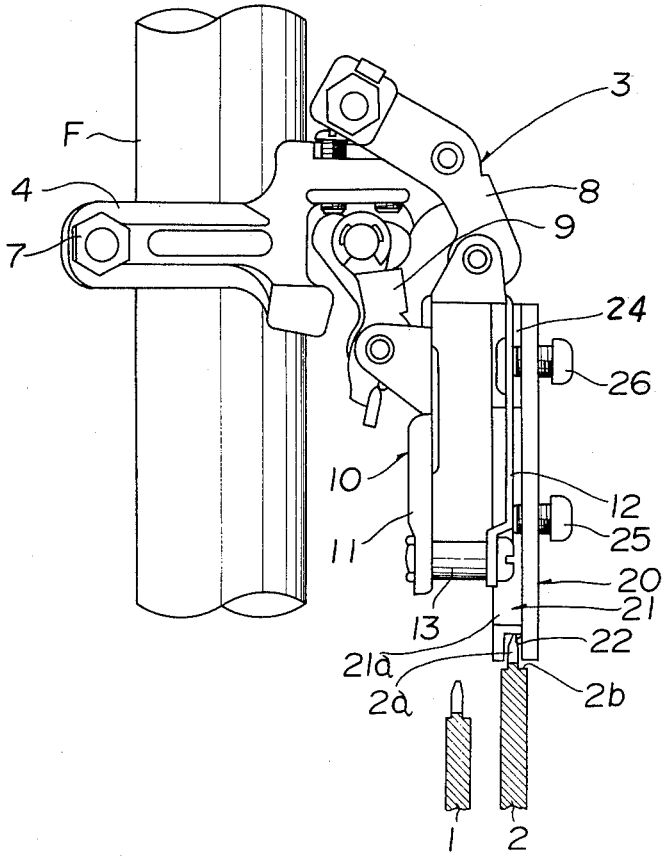
Figure 4:
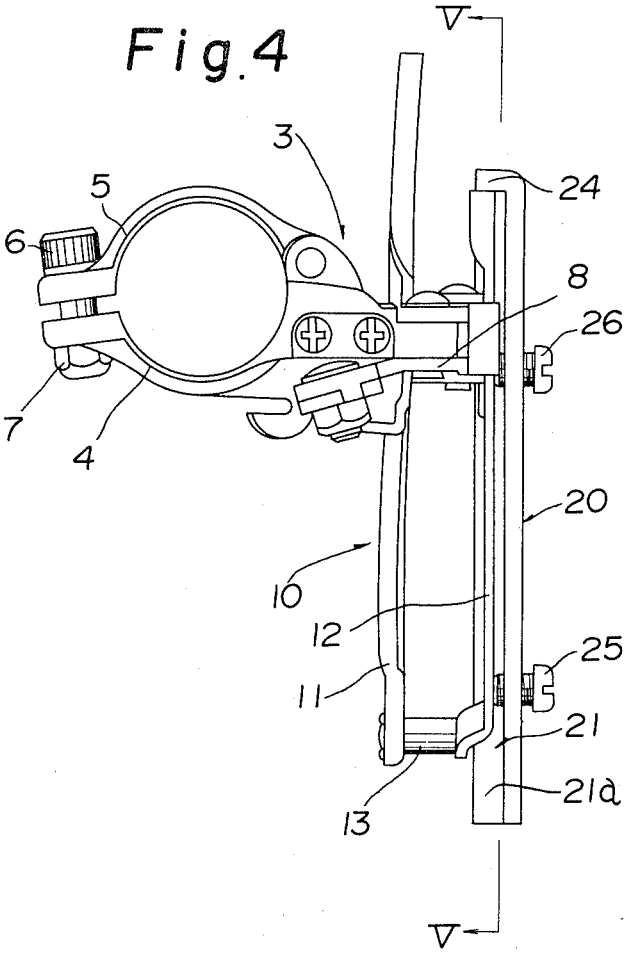

In greater detail, the main body 20, as shown in FIGS. 3 and 4, is opposite to the outer side of second guide plate 12, has a length extending along the guide plate 12, and is shaped lengthwise in a circular arc of a curvature approximately equal to that of the larger diameter high speed chain gear 2.

The receiving plate 21 is provided at one side of the main body 20 throughout the whole length thereof and is integral with the main body 20 as shown in FIG. 2, the receiving face 21*a* being shaped in a circular arc fit to the lower end face of guide plate 12.

The engaging portion 22 comprises; the lower portion of main body 20; the receiving plate 21; and a plate 23 projecting downwardly from the widthwise end of receiving plate 21, extending lengthwise throughout thereof, and being opposite to the lower portion of main body 20.

Figure 5:
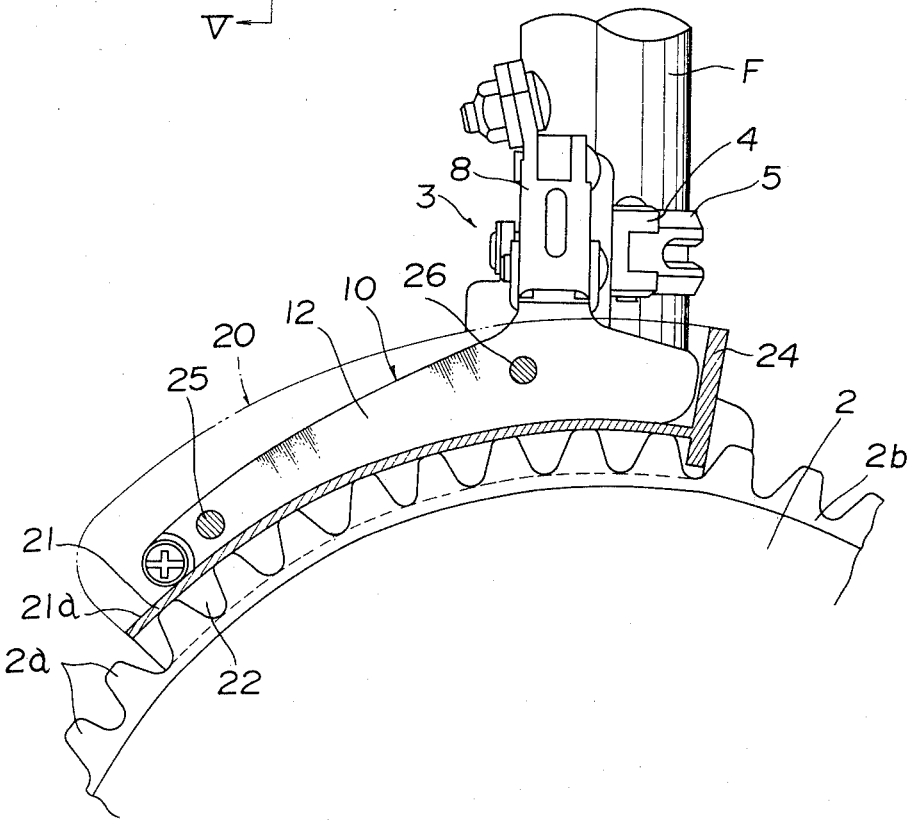

In the aforesaid construction, when the engaging portion 22, as shown in FIGS. 3 through 5, engages with the outer peripheral portion of high speed chain gear 2, the receiving face 21*a* at the receiving plate 21, as shown in FIG. 3, is kept in a proper position with respect to the teeth 2*a* at the chain gear 2. Hence, the second guide plate 12 at the front derailleur 3 is placed on and along the receiving face 21*a* to set the guide plate 12, therefore the chain guide 10, in the proper radial position with respect to the chain gears 1 and 2 and at an angle with respect to the common axis of chain gears 1 and 2.

In addition, it is preferable that a stopper 24, as shown, is provided at a side of one lengthwise end of main body 20 in contact with one lengthwise end of the guide plate 12.

The stopper 24, when the front derailleur 3 is set in position, abuts against the front end face of second guide plate 12, so that the main body 20 may engage stably with the guide plate 12, thereby preventing the main body 20 from freely moving.

Furthermore, it is preferably that in the vicinity of both lengthwise ends of main body 20 there are provided at least two adjustment bolts 25 and 26 extending in the projecting direction of receiving plate 21. By this, the angled chain guide 10 with respect to the axis of chain gear 2 is made finely adjustable.

Alternatively, the jig of the invention may engage at its engaging portion 22 with the smaller diameter low speed chain gear 1 to thereby set the front derailleur 3 in position. Also, the main body 20, alternatively, may abut at its inner periphery against a stepped portion 2*b* formed at the chain gear 2 in the vicinity of teeth 2*a* thereof and extending circumferentially of the gear 2.

Furthermore, the receiving face 21*a*, which receives the second guide plate 12 only in the embodiment, may receive the first guide plate 11 together to thereby set the front derailleur 3 in position.

Next, the way to use the aforesaid jig for mounting the front derailleur 3 on the bicycle frame in a proper position with respect to the chain gears 1 and 2 will be described.

At first, the fixing member 4 and arm 5 at the front derailleur 3 are fit onto the bicycle frame F, and the bolt 6 and nut 7 are temporarily tightened to mount the front derailleur 3 on the frame F.

Then, the engaging portion 22 at the jig body 20, as shown in FIG. 5, is fit onto the teeth 2*a* of the larger diameter high speed chain gear 2 to engage the main body 20 with the outer peripheral portion of the gear 2, and the second guide plate 12 of the chain guide 10 is placed on the receiving face 21*a*. In this instance, if the guide plate 12 is slanted longitudinally with respect to the receiving face 21*a* to partially rise apart therefrom, or slanted with respect to the main body 20 and not be in parallel thereto, such a shift in position can immediately be found by the reference plane arranged. Hence, for the purpose of compensating the shift, the fixing member 4 is moved vertically or rotated with respect to the bicycle frame F, thereby adjusting the chain guide 10 to arrange the guide plate 12 in the proper position along the main body 20 and receiving face 21*a*.

When arranged along the main body 20 and receiving face 21*a*, the guide plate 12, and therefore the chain guide 10, is set in a proper position with respect to the chain gears 1 and 2.

Then, the bolt 6 and nut 7 are screwably tightened to fix the front derailleur 3 to the frame F. Thereafter, the main body 20 of the jig is removed from the chain gear 2.

Accordingly, the aforesaid mounting for the front derailleur 3 enables the chain guide 10 to be set accurately in the proper position with respect to the chain gears 1 and 2.

As clearly understood from the aforesaid description, the jig according to the invention is able to set the front derailleur readily in the proper position with respect to the outer peripheral portion of the chain gear. Furthermore, whoever mounts the front derailleur on the bicycle frame can set the derailleur accurately in its proper position to keep its desired performance for changing speed. Hence, the chain is prevented from escaping from the chain gear, and also noises are eliminated when changing speed.

While an embodiment of the invention has been shown and described, the invention is not limited to the specific construction thereof, which is merely exemplary of the invention defined more particularly by the claims which follow.

What is claimed is:

1. A jig for mounting a front derailleur having a pair of guide plates on a frame of a bicycle in a proper position in correspondence with a plurality of front chain gears of different diameters, said jig comprising, a main body adapted to be positioned opposite to at least one of said guide plates for setting said one guide plate in a predetermined position relative to said chain gears and comprising: a plate having a length which extends the length of said one guide plate, a receiving plate which projects substantially perpendicularly from a lower portion of said main body and has a receiving face of circular arc conforming to the lower end face of said one guide plate, an engaging portion positioned at a lower portion of said receiving plate and shaped to engage with the outer peripheral portion of one of said chain gears, so that when said engaging portion engages with the outer peripheral portion of said chain gear, said receiving face is adapted to receive said one guide plate and set it in a proper position with respect to teeth on said chain gear, and at least two adjustment bolts extending in the projecting direction of said receiving plate and provided in the vicinity of both lengthwise ends of said main body, the extension of said bolts in the projecting direction of said receiving plate being adjustable.

2. A jig for mounting a front derailleur according to claim 1, wherein a stopper in contact with one lengthwise end of said guide plate is provided at a side of one lengthwise end of said main body.

* * * * *